US008081176B2

(12) United States Patent
Han et al.

(10) Patent No.: US 8,081,176 B2
(45) Date of Patent: Dec. 20, 2011

(54) PHOTOSENSOR FOR DISPLAY DEVICE

(75) Inventors: Hsi-Rong Han, Tai Chung County (TW); Chien-Ting Chan, Chang Hua County (TW)

(73) Assignee: Wintek Corporation, Taichung (TW)

( * ) Notice: Subject to any disclaimer, the term of this patent is extended or adjusted under 35 U.S.C. 154(b) by 500 days.

(21) Appl. No.: 12/388,960

(22) Filed: Feb. 19, 2009

(65) Prior Publication Data

US 2009/0207157 A1 Aug. 20, 2009

(30) Foreign Application Priority Data

Feb. 19, 2008 (TW) ..... 97105669 A

(51) Int. Cl.
*G09G 5/00* (2006.01)

(52) U.S. Cl. ..... 345/207

(58) Field of Classification Search ..... None
See application file for complete search history.

(56) References Cited

U.S. PATENT DOCUMENTS 7,218,048 B2 5/2007 Choi et al.
2005/0087825 A1 4/2005 Cok
2005/0151065 A1 7/2005 Min
2005/0218302 A1 10/2005 Shin et al.
2006/0077167 A1 4/2006 Kim et al.

*Primary Examiner* — Paul Huber
(74) *Attorney, Agent, or Firm* — Muncy, Geissler, Olds & Lowe, PLLC

(57) ABSTRACT

A photosensor for a display device includes a light receiver, a reset unit, and a sample unit. The light receiver is used for receiving ambient light to generate a photovoltage. The light receiver includes a first transistor and a first conversion unit that transforms the output of the first transistor into the photovoltage. The reset unit is used for providing an initiated reference voltage in response to a reset signal and includes a second transistor and a third transistor that are connected with each other, where the first conversion unit is discharged through the third transistor to obtain the initiated reference voltage when the second transistor is turned on. The sample unit is used for outputting the photovoltage in respond to a sample signal, the sample unit comprising a fourth transistor in respond to the sample signal and a second conversion unit that transforms the output of the fourth transistor into the photovoltage.

20 Claims, 6 Drawing Sheets

PHOTOSENSOR FOR DISPLAY DEVICE

CROSS REFERENCE TO RELATED APPLICATION

This application claims priority of application No. 097105669 filed in Taiwan R.O.C on Feb. 19, 2008 under 35 U.S.C. §119; the entire contents of which are hereby incorporated by reference.

BACKGROUND OF THE INVENTION

1. Field of the Invention

The invention relates to a photosensor, particularly to a photosensor that is provided in a display device to measure the intensity of ambient light.

2. Description of the Related Art

It has been suggested that an ambient light sensor is provided in a display device to measure the intensity of ambient light and correspondingly adjust the light intensity of a light source built in the display device. Thereby, optimum display contrast can be achieved and power consumption is allowed to be reduced.

FIG. 1 shows an equivalent circuit diagram of a conventional photosensor, and FIG. 2 shows an exemplary timing chart of input signals for the photosensor 100 shown in FIG. 1. Referring to both FIG. 1 and FIG. 2, the photosensor 100 includes a sensor transistor Q1, a selection transistor Q2, a current-generating transistor Q3, an output transistor Q4, and a storage capacitor C1. The photosensor outputs a sensor current Iout whose magnitude depends on the amount of received ambient light. The sensor transistor Q1 is supplied with a first voltage VDD and a second voltage VGG. When the selection signal SELECT is in a high level, the selection transistor Q2 is turned on to electrically connect the sensor transistor Q1 and the storage capacitor C1 with the first voltage VDD. At this time, the sensor transistor Q1 does not generate any photocurrent and the storage capacitor C1 is initiated to be charged with the first voltage VDD. Then, when the read signal READ is in a high level, the output transistor Q4 is turned on and outputs the first voltage VDD in response to the read signal READ. On the other hand, when the selection signal SELECT is in a low level, the selection transistor Q2 is turned off to disconnect the sensor transistor Q1 and the storage capacitor C1 from the first voltage VDD. Accordingly, the storage capacitor C1 begins storing electrical charges to generate the photovoltage that is applied to the current-generating transistor Q3. Hence, the magnitude of the sensor current Iout depends on the difference between the photovoltage and the first voltage VDD. Further, when the read signal READ is in a high level, the output transistor Q4 is turned on and outputs the photovoltage whose magnitude is in proportion to the sensor current Iout.

However, according to the above design, the current-generating transistor Q3 is subjected to a long-term negative bias to cause a shift in the threshold voltage of the transistor Q3 to damage the transistor Q3. Besides, since the voltage at node n1 is set as the first voltage VDD during each reset operation, the difference between the photovoltage and the first voltage VDD (serving as a reference voltage) is quite small.

FIG. 3 shows an equivalent circuit diagram of another conventional photosensor 200. Referring to FIG. 3, the photosensor 200 includes a sensor circuit 202, a reference voltage generating circuit 204 and a processor 206. The sensor circuit 202 includes a sensor transistor Q1, a reset transistor Q2, a switching transistor Q3 and two capacitors C1 and C2. The reference voltage generating circuit 204 includes a sensor transistor Q4, a reset transistor Q5, a switching transistor Q6 and two capacitors C3 and C4. The sensor transistor Q1 is supplied with a first voltage VDD and a second voltage VGG, and the two capacitors C1 and C2 are connected to a third voltage VDC. The photosensor 200 is enabled by a gate driver (not shown). Specifically, when the reset transistor Q2 is turned on to perform a reset operation, the switching transistor Q3 is turned on by the output of a first stage of the gate driver to obtain a reference voltage Δ V1 for the switching transistor Q3. Then, after the sensor transistor Q1 receives ambient light for some time, the switching transistor Q3 is turned on by the output of a last stage of the gate driver to obtain a photovoltage Δ V2 for the switching transistor Q3. According to the above design, the reset operation allows for a competently large difference between the photovoltage and the reference voltage. However, such design requires two distinct circuits, the sensor circuit 202 for generating the photovoltage and the reference voltage generating circuit 204 for generating the reference voltage, to cause a considerable number of constituting components and high fabrication costs.

BRIEF SUMMARY OF THE INVENTION

The invention relates to a photosensor for a display device having comparatively less constituting components, a wide sensing range, and an improved operation life.

According to an embodiment of the invention, a photosensor for a display device includes a light receiver, a reset unit, and a sample unit. The light receiver is used for receiving ambient light to generate a photovoltage whose magnitude is in proportion to the amount of the ambient light received by the light receiver. The light receiver includes a first transistor and a first conversion unit that transforms the output of the first transistor into the photovoltage. The reset unit is used for providing an initiated reference voltage in response to a reset signal. The reset unit includes a second transistor and a third transistor that are connected with each other, the control terminal of the second transistor being connected to the reset signal and the control terminal of the third transistor being connected to the first conversion unit, where the first conversion unit is discharged through the third transistor to obtain the initiated reference voltage when the second transistor is turned on. The sample unit is used for outputting the photovoltage in respond to a sample signal, the sample unit comprising a fourth transistor in respond to the sample signal and a second conversion unit that transforms the output of the fourth transistor into the photovoltage.

According to another embodiment of the invention, a photosensor for a display device includes a sensor circuit, a reference voltage generating circuit, and a processing unit. The sensor circuit includes a first light receiver for receiving ambient light to generate a photovoltage whose magnitude is in proportion to the amount of the ambient light received by the first light receiver, the first light receiver comprising a first transistor and a first conversion unit that transforms the output of the first transistor into the photovoltage; a first reset unit for providing an initiated reference voltage in response to a reset signal and comprising a second transistor and a third transistor that are connected with each other, the control terminal of the second transistor being connected to the reset signal and the control terminal of the third transistor being connected to the first conversion unit, wherein the first conversion unit is discharged through the third transistor to obtain the initiated reference voltage when the second transistor is turned on; and a first read unit for outputting the photovoltage in respond to a first read signal and comprising a fourth transistor in respond to the first read signal and a second conversion unit that transforms the output of the fourth transistor into the photovoltage. The reference voltage generating circuit includes a second light receiver being shielded from ambient light, the second light receiver comprising a fifth transistor and a third conversion unit that transforms the output of the fifth transistor into the reference voltage; a second reset unit for providing an initiated reference voltage in response to a second reset signal and comprising a sixth transistor and a seventh transistor that are connected with each other, the control terminal of the sixth transistor being connected to the second reset signal and the control terminal of the seventh transistor being connected to the third conversion unit, where the third conversion unit is discharged through the seventh transistor to obtain the initiated reference voltage when the sixth transistor is turned on; and a second read unit for outputting the reference voltage in respond to a second read signal and comprising a eighth transistor in respond to the second sample signal and a fourth conversion unit that transforms the output of the fourth transistor into the reference voltage. The processing unit is used for receiving the photovoltage and the reference voltage to generate an output signal in respond to the difference between the photovoltage and the reference voltage.

According to the above embodiments, during each reset operation of the photosensor, the voltage level in a storage capacitor is reduced to the threshold voltage of the third transistor by the auto-zero discharge operation of the reset circuit and then gradually increased by the reception of ambient light. Thereby, a considerable difference between the output photovoltage and the reference voltage is obtained. Further, since the output photovoltage and the reference voltage are both fetched from a same circuit, the constituting components and layout areas are decreased to reduce fabrication costs. Further, the sensor transistor typically operates within a negative bias portion of a transistor operation graph, since the current characteristics are better as the sensor transistor operates within this portion. However, in case the sensor transistor is negatively biased for a long time, it is liable to cause a shift in its threshold voltage to damage the sensor transistor. In comparison, according to the above embodiment, since the gate bias signal triggers one time per frame, the sensor transistor is alternately subjected to a positive bias (positive voltage VGH) and a negative bias (photovoltage) to effectively avoid the threshold voltage shift.

Other objectives, features and advantages of the present invention will be further understood from the further technological features disclosed by the embodiments of the present invention wherein there are shown and described preferred embodiments of this invention, simply by way of illustration of modes best suited to carry out the invention.

DETAILED DESCRIPTION OF THE INVENTION

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and variations thereof herein are used broadly and encompass direct and indirect connections, couplings, and mountings. Similarly, "adjacent to" and variations thereof herein are used broadly and encompass directly and indirectly "adjacent to". Therefore, the description of "A" component "adjacent to" "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
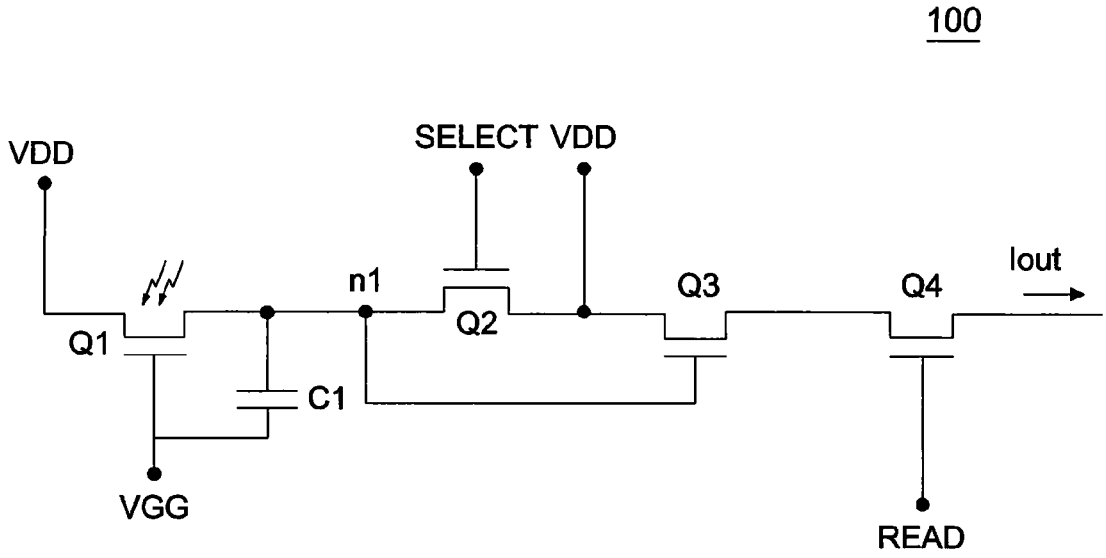
FIG. 1 (Prior Art)
FIG. 1 shows an equivalent circuit diagram of a conventional photosensor.
Figure 2:
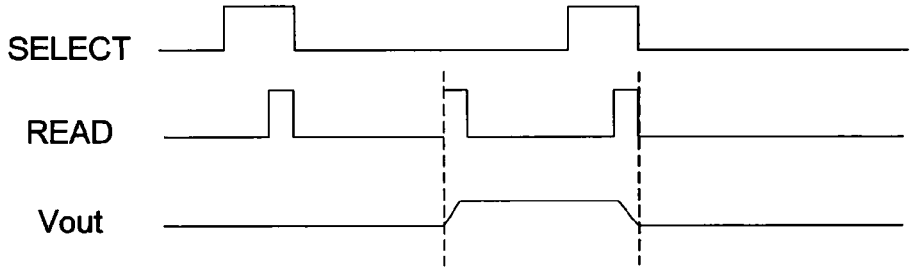
FIG. 2 (Prior Art)
FIG. 2 shows an exemplary timing chart of input signals for the photosensor shown in FIG. 1.
Figure 3:
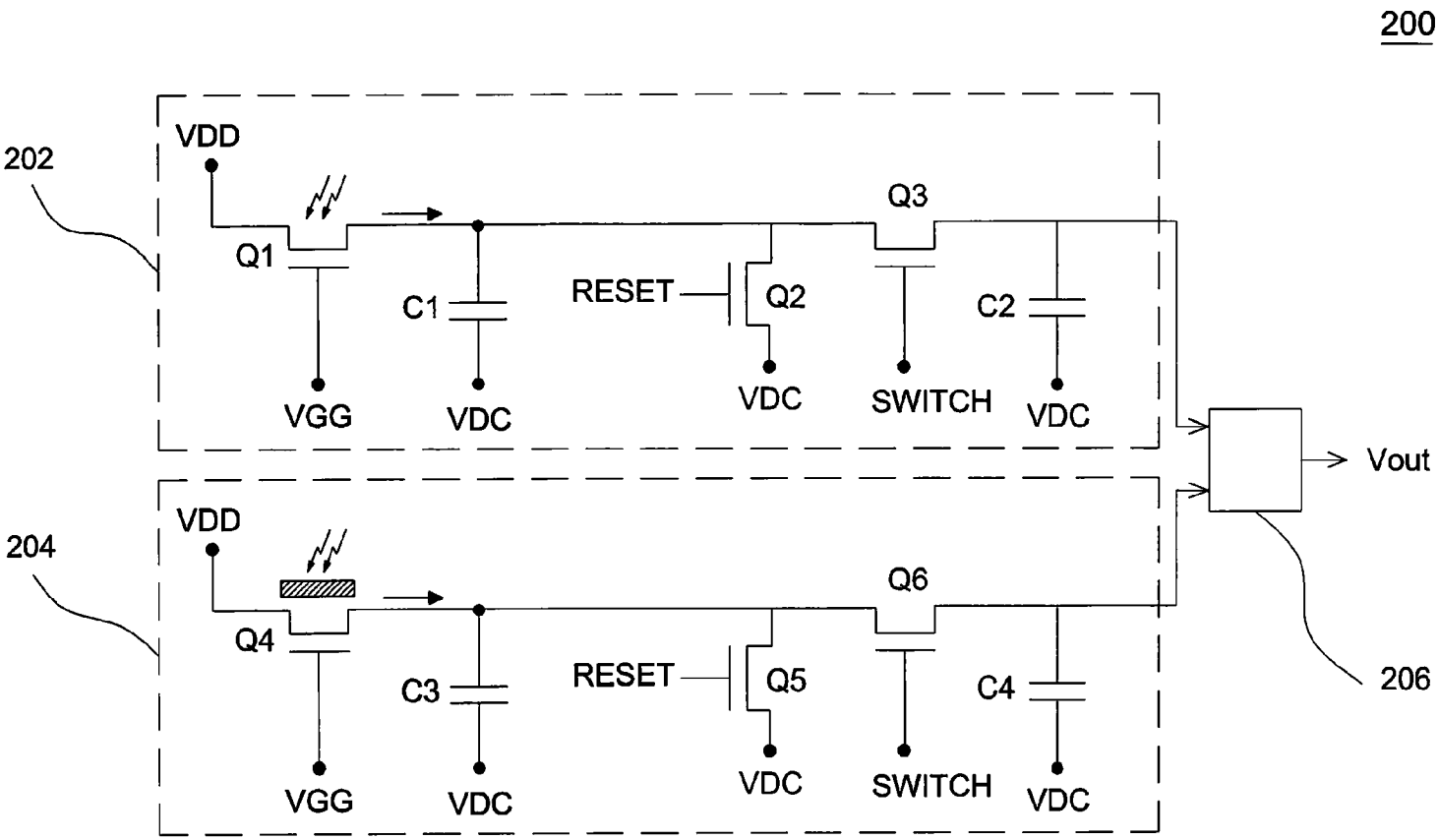
FIG. 3 (Prior Art)
FIG. 3 shows an equivalent circuit diagram of another conventional photosensor.
Figure 4:
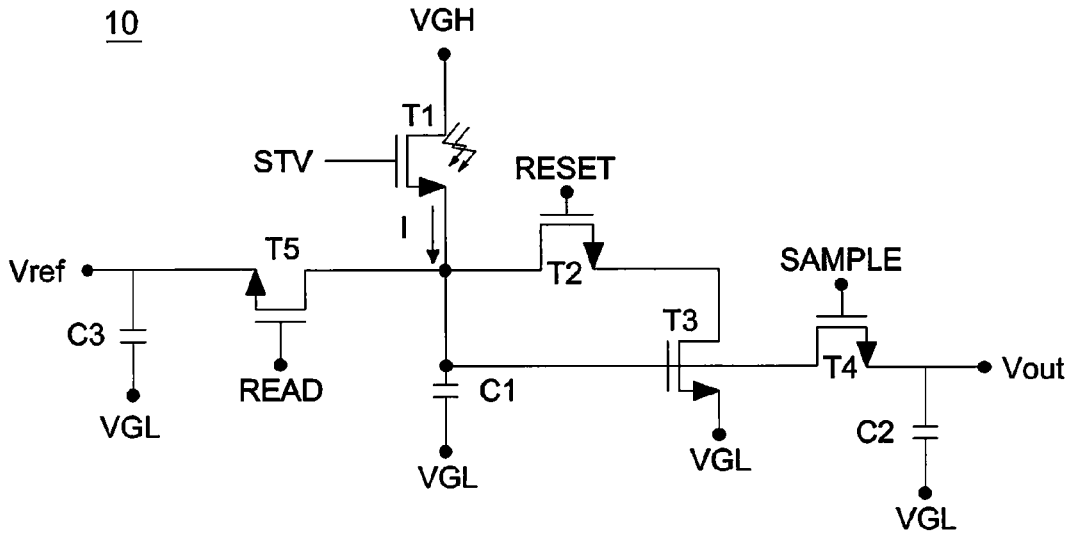
FIG. 4 shows an equivalent circuit diagram of a photosensor according to an embodiment of the invention.
Figure 5:
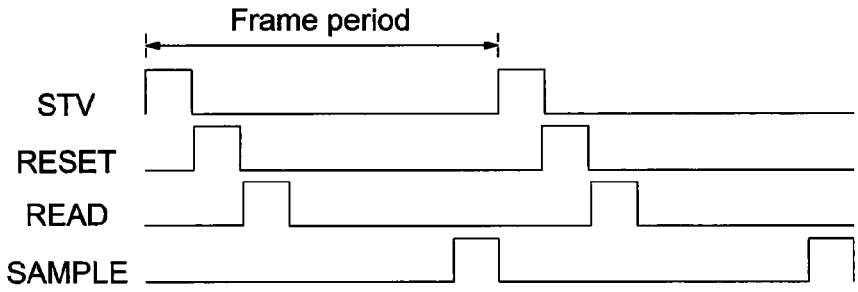
FIG. 5 shows an exemplary timing chart of input signals for the photosensor shown in FIG. 4.

FIG. 4 shows an equivalent circuit diagram of a photosensor 10 according to an embodiment of the invention, and FIG. 5 shows an exemplary timing chart of input signals for the photosensor 10 shown in FIG. 4. According to this embodiment, the photosensor 10 is provided in a display device (not shown) to measure the intensity of ambient light, and thus a gate driver IC may serve as a voltage source for the photosensor 10. Referring to FIG. 4, the photosensor 10 includes a first transistor T1, a second transistor T2, a third transistor T3, a fourth transistor T4, a fifth transistor T5, a first capacitor C1, a second capacitor C2, and a third capacitor C3. The gate of the first transistor T1 is connected to an initiated scan signal STV, its drain is connected to a first voltage, and its source is connected to a second voltage and the first capacitor C1. For example, the first voltage and the second voltage may be a positive voltage VGH and a negative voltage VGL, respectively. The gate of the second transistor T2 is connected to a reset signal RESET, its drain is connected to the source of the first transistor T1. The drain of the third transistor T3 is connected to the source of the second transistor T2, its source is connected to the negative voltage VGL, and its gate is connected to the source of the first transistor T1 and the first capacitor C1. The gate of the fourth transistor T4 is connected to a sample signal SAMPLE, its drain is connected to the first capacitor C1, and its source is connected to the second capacitor C2. The gate of the fifth transistor T5 is connected to a read signal READ, its drain is connected to the source of the first transistor T1 and the first capacitor C1, and its source is connected to the third capacitor C3.

The first transistor T1 has a light-sensitive layer (not shown) that is capable of generating electrical charge carriers upon receiving ambient light. The electrical charge carriers move to form photocurrent I as a result of the voltage difference between the drain and the source of the first transistor T1, and the magnitude of the photocurrent I is in proportion to the amount of received ambient light. Referring to both FIG. 4 and FIG. 5, when the initiated scan signal STV is in a high level, the first transistor T1 is turned on and the positive voltage VGH charges the first capacitor C1 through the first transistor T1. Next, when the reset signal RESET is in a high level, the second transistor T2 is turned on and the third transistor T3 is also turned on to discharge the electrical charges stored in the first capacitor C1 through the third transistor T3. Hence, the voltage level of the first capacitor C1 is reduced to be the same or almost the same as the threshold voltage of the third transistor T3. Then, when the read signal READ is in a high level, the fifth transistor T5 is turned on and the output of the fifth transistor T5 is transformed to the voltage difference of the third capacitor C3. Therefore, a reference voltage Vref that equals the threshold voltage of the third transistor T3 is fetched from the third capacitor C3. Since each manufactured transistor T3 has its respective threshold voltage as a result of fabrication tolerances, the above design that uses the threshold voltage of a third transistor T3 as a reference voltage Vref allows for an optimum reference voltage Vref for the photosensor 10 without influenced by the inherent distinctions of different transistors T3. On the other hand, when the reset signal RESET is in a low level, the second transistor T2 is turned off and the voltage level of the first capacitor C1 is gradually increased since the photocurrent I flows into the first capacitor C1, with the reference voltage Vref continually kept at a fixed value.

Hence, when the sample signal SAMPLE is in a high level, the fourth transistor T4 is turned on and the output of the fourth transistor T4 is transformed to a voltage difference of the second capacitor C2. Thereby, a photovoltage Vout that varies in relation to the reception of ambient light and equals the voltage level of the first capacitor C1 charged by the photocurrent I is fetched from the second capacitor C2.

Figure 6:
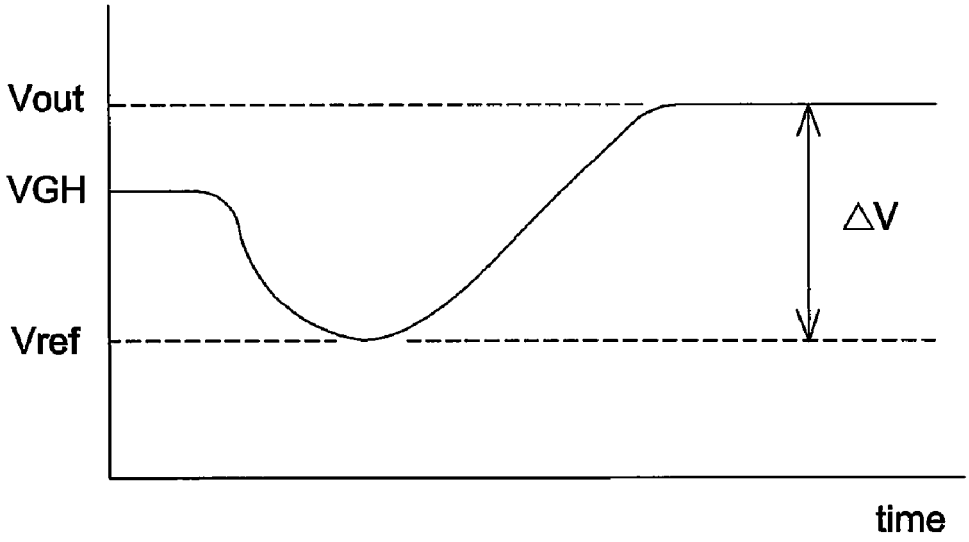
FIG. 6 shows a curve diagram illustrating variations in the voltage level of the first capacitor.
Figure 7:
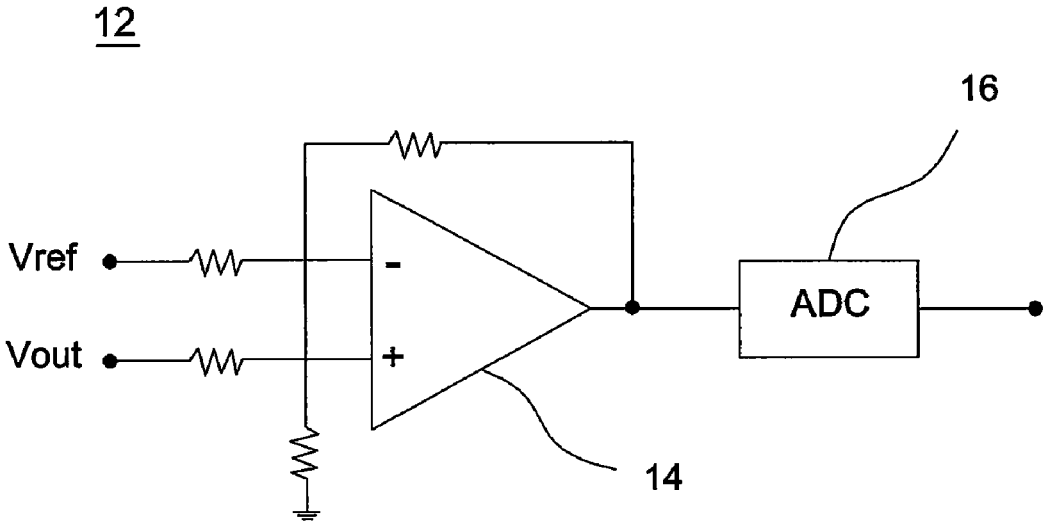
FIG. 7 shows a schematic diagram of a processing unit according to an embodiment of the invention.

FIG. 6 shows a curve diagram illustrating variations in the voltage level of the first capacitor C1. From FIG. 6, it can be clearly seen that the second transistor T2 cooperates with the third transistor T3 to perform an auto-zero discharge operation. In that case, the voltage level of the first capacitor C1 that at first equals the positive voltage VGH is reduced to be the same or almost the same as the threshold voltage of the third transistor T3, with the threshold voltage serving as a fixed reference voltage Vref. Then, the voltage level of the first capacitor C1 is gradually increased accompanying with the reception of ambient light. Finally, a voltage difference Δ V between the photovoltage Vout and the reference voltage Vref is sampled and then output. As shown in FIG. 7, a processing unit 12 receives the output photovoltage Vout and the reference voltage Vref to generate an output signal corresponding to a difference between them. Specifically, the processing unit 12 includes an amplifier 14 and an analogue-to-digital converter (ADC) 16. The voltage difference Δ V between the photovoltage Vout and the reference voltage Vref is amplified by the amplifier 14 and transformed into digital luminous control signals by the ADC 16, and the brightness of a backlight is adjusted according to the luminous control signals. Thereby, optimum display contrast and reduced power consumption are achieved.

According to the above embodiment, during each reset operation of the photosensor 10, the voltage level in a storage capacitor is reduced to the threshold voltage of the third transistor T3 by the auto-zero discharge operation of the reset circuit and then gradually increased by the reception of ambient light. Thereby, a considerable difference between the output photovoltage and the reference voltage is obtained. Further, since the output photovoltage and the reference voltage are both fetched from a same circuit, the constituting components and layout areas are decreased to reduce fabrication costs. Further, the sensor transistor (first transistor T1) typically operates within a negative bias portion of a transistor operation graph, since the current characteristics are better as the sensor transistor operates within this portion. However, in case the first transistor T1 is negatively biased for a long time, it is liable to cause a shift in its threshold voltage to damage the first transistor T1. In comparison, according to the above embodiment, since the gate bias signal triggers one time per frame, the first transistor T1 is alternately subjected to a positive bias (positive voltage VGH) and a negative bias (photovoltage) to effectively avoid the threshold voltage shift.

Figure 8:
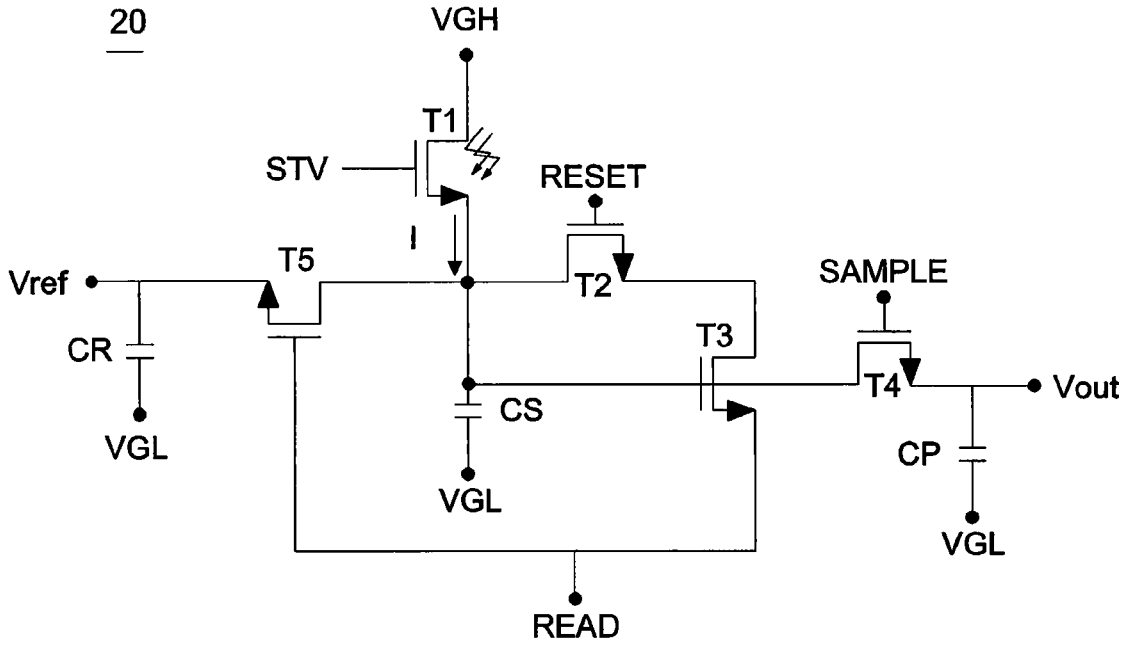
FIG. 8 shows an equivalent circuit diagram of a photosensor according to another embodiment of the invention.
Figure 9:
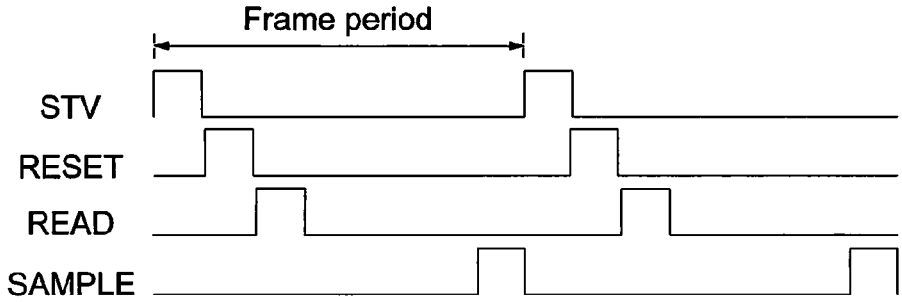
FIG. 9 shows an exemplary timing chart of input signals for the photosensor shown in FIG. 8.

FIG. 8 shows an equivalent circuit diagram of a photosensor 20 according to another embodiment of the invention, and FIG. 9 shows an exemplary timing chart of input signals for the photosensor 20 shown in FIG. 8. Referring to both FIG. 8 and FIG. 9, in this embodiment, the read signal READ is connected to both the gate of the fifth transistor T5 and the source of the third transistor T3, so the third transistor T3 is allowed to be turned off when the read signal READ is in a high level.

Figure 10:
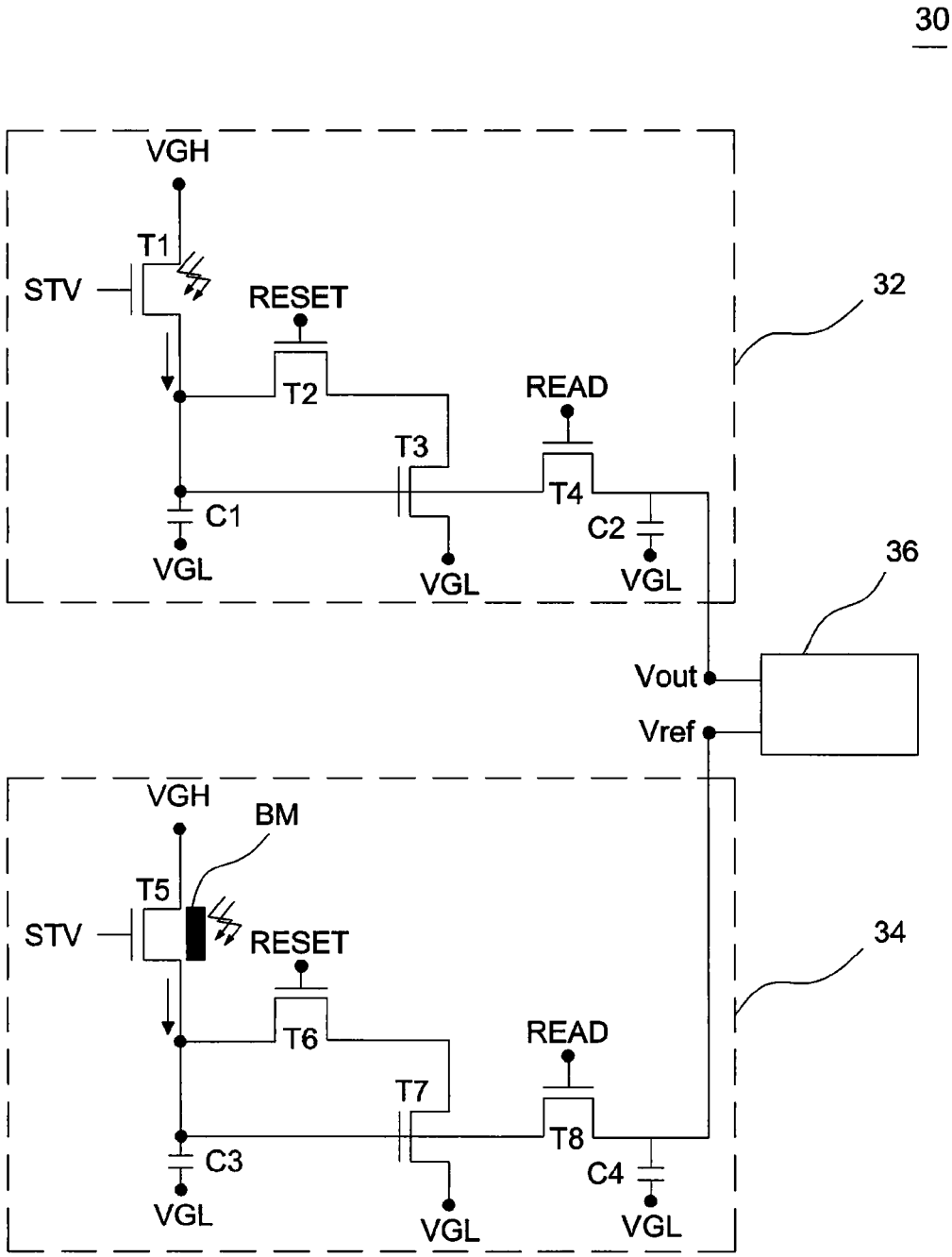
FIG. 10 shows an equivalent circuit diagram of a photosensor according to another embodiment of the invention.

FIG. 10 shows an equivalent circuit diagram of a photosensor 30 according to another embodiment of the invention, and the timing chart of input signals for the photosensor 30 is similar to that shown in FIG. 9. Referring to FIG. 10, the photosensor 30 includes a sensor circuit 32, a reference voltage generating circuit 34, and a processing unit 36. The sensor circuit 32 includes a first transistor T1, a second transistor T2, a third transistor T3, a fourth transistor T4, a first capacitor C1 and a second capacitor C2. The input terminal of the first transistor T1 is connected to a positive voltage VGH, its control terminal is connected to an initiated scan signal STV, and its output terminal is connected to the first capacitor C1. The input terminal of the second transistor T2 is connected to the output terminal of the first transistor T1, and the control terminal of the second transistor T2 is connected to a reset signal RESET. The input terminal of the third transistor T3 is connected to the output terminal of the second transistor T2. The control terminal of the third transistor T3 is connected to the first capacitor C1, and the output terminal of the third transistor is connected to a negative voltage VGL. The input terminal of the fourth transistor T4 is connected to the first capacitor C1, its control terminal is connected to the read signal READ, and its output terminal is connected to the second capacitor C2. The reference voltage generating circuit 34 includes a fifth transistor T5, a sixth transistor T6, a seventh transistor, a eighth transistor T8, a third capacitor C3, and a fourth capacitor C4. The connection of constituting components of the reference voltage generating circuit 34 is similar to that of the sensor circuit 32, thus not explaining in detail here. The major difference lies in that an additional light blocking member BM is provided in the reference voltage generating circuit 34 to shield the fifth transistor T5 from the illumination of ambient light. In comparison, the first transistor T1 of the sensor circuit 32 is illuminated by ambient light to generate a photovoltage whose magnitude is in proportion to the received light amount. Hence, the sensor circuit 32 outputs the photovoltage Vout whose magnitude is in proportion to the amount of receiving ambient light, and the reference voltage generating circuit 34 outputs a fixed reference voltage Vref. The processing unit 36 receives the photovoltage Vout and the reference voltage Vref to generate an output signal in proportion to their voltage difference. As shown in FIG. 7, the processing unit 36 may include an amplifier 14 and an analogue-to-digital converter (ADC) 16. In this embodiment, the second transistor T2 and the third transistor T3 of the sensor circuit 32 similarly response the reset signal RESET to perform an afore-mentioned auto-zero discharge operation so as to provide an initiated photovoltage. Further, the sixth transistor T6 and the seventh transistor T7 of the reference voltage generating circuit 34 similarly response the reset signal RESET to perform an auto-zero discharge operation so as to provide an initiated reference voltage.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A photosensor for a display device, comprising:

a light receiver for receiving ambient light to generate a photovoltage whose magnitude is in proportion to the amount of the ambient light received by the light receiver, the light receiver comprising a first transistor and a first conversion unit that transforms the output of the first transistor into the photovoltage;

a reset unit for providing an initiated reference voltage in response to a reset signal and comprising a second transistor and a third transistor that are connected with each other, the control terminal of the second transistor being connected to the reset signal and the control terminal of the third transistor being connected to the first conversion unit, wherein the first conversion unit is discharged through the third transistor to obtain the initiated reference voltage when the second transistor is turned on; and a sample unit for outputting the photovoltage in respond to a sample signal, the sample unit comprising a fourth transistor in respond to the sample signal and a second conversion unit that transforms the output of the fourth transistor into the photovoltage.

2. The photosensor as claimed in claim 1, wherein the first and the second conversion units are each a capacitor.

3. The photosensor as claimed in claim 1, wherein the input terminal of the first transistor is connected to a positive voltage, its control terminal is connected to an initiated scan signal, and its output terminal is connected to the first conversion unit.

4. The photosensor as claimed in claim 1, wherein the input terminal of the second transistor is connected to the output terminal of the first transistor, the input terminal of the third transistor is connected to the output terminal of the second transistor, and the output terminal of the third transistor is connected to a negative voltage.

5. The photosensor as claimed in claim 1, wherein the input terminal of the fourth transistor is connected to the first conversion unit, its control terminal is connected to the sample signal, and its output terminal is connected to the second conversion unit.

6. The photosensor as claimed in claim 1, wherein the reference voltage is substantially the threshold voltage of the third transistor.

7. The photosensor as claimed in claim 1, further comprising a reference voltage output unit in respond to a read signal to output the reference voltage, and the reference voltage output unit comprising a fifth transistor in respond to the read signal and a third conversion unit that transforms the output of the fifth transistor into the reference voltage.

8. The photosensor as claimed in claim 7, wherein the third conversion unit is a capacitor.

9. The photosensor as claimed in claim 7, wherein the input terminal of the fifth transistor is connected to the first conversion unit and the output terminal of the first transistor, its control terminal is connected to the read signal, and its output terminal is connected to the third conversion unit.

10. The photosensor as claimed in claim 9, wherein the read signal is connected to the output terminal of the third transistor.

11. The photosensor as claimed in claim 1, further comprising a processing unit that receives the photovoltage and the reference voltage to generate an output signal in respond to the difference between the photovoltage and the reference voltage.

12. The photosensor as claimed in claim 11, wherein the processing unit comprises an amplifier and an analogue-to-digital converter (ADC), the difference between the photovoltage and the reference voltage being amplified by the amplifier and transformed into digital luminous control signals by the ADC.

13. A photosensor for a display device, comprising:

a sensor circuit, comprising:

a first light receiver for receiving ambient light to generate a photovoltage whose magnitude is in proportion to the amount of the ambient light received by the first light receiver, the first light receiver comprising a first transistor and a first conversion unit that transforms the output of the first transistor into the photovoltage;

a first reset unit for providing an initiated reference voltage in response to a reset signal and comprising a second transistor and a third transistor that are connected with each other, the control terminal of the second transistor being connected to the reset signal and the control terminal of the third transistor being connected to the first conversion unit, wherein the first conversion unit is discharged through the third transistor to obtain the initiated reference voltage when the second transistor is turned on; and a first read unit for outputting the photovoltage in respond to a first read signal and comprising a fourth transistor in respond to the first read signal and a second conversion unit that transforms the output of the fourth transistor into the photovoltage;

a reference voltage generating circuit, comprising:

a second light receiver being shielded from ambient light, the second light receiver comprising a fifth transistor and a third conversion unit that transforms the output of the fifth transistor into the reference voltage;

a second reset unit for providing an initiated reference voltage in response to a second reset signal and comprising a sixth transistor and a seventh transistor that are connected with each other, the control terminal of the sixth transistor being connected to the second reset signal and the control terminal of the seventh transistor being connected to the third conversion unit, wherein the third conversion unit is discharged through the seventh transistor to obtain the initiated reference voltage when the sixth transistor is turned on; and a second read unit for outputting the reference voltage in respond to a second read signal and comprising an eighth transistor in respond to the second sample signal and a eighth transistor unit that transforms the output of the fourth transistor into the reference voltage; and a processing unit for receiving the photovoltage and the reference voltage to generate an output signal in respond to the difference between the photovoltage and the reference voltage.

14. The photosensor as claimed in claim 13, wherein the reference voltage generating circuit further comprising a light blocking member to shield the fifth transistor from the illumination of ambient light.

15. The photosensor as claimed in claim 13, wherein the first, the second, the third, and the fourth conversion units are each a capacitor.

16. The photosensor as claimed in claim 13, wherein the input terminal of the first transistor is connected to a positive voltage, its control terminal is connected to an initiated scan signal, and its output terminal is connected to the first conversion unit.

17. The photosensor as claimed in claim 13, wherein the input terminal of the second transistor is connected to the output terminal of the first transistor, the input terminal of the third transistor is connected to the output terminal of the second transistor, and the output terminal of the third transistor is connected to a negative voltage.

18. The photosensor as claimed in claim 13, wherein the input terminal of the fourth transistor is connected to the first conversion unit, its control terminal is connected to the read signal, and its output terminal is connected to the second conversion unit.

19. The photosensor as claimed in claim 13, wherein the input terminal of the fifth transistor is connected to a positive voltage, its control terminal is connected to an initiated scan signal, and its output terminal is connected to the third conversion unit.

20. The photosensor as claimed in claim 13, wherein the input terminal of the sixth transistor is connected to the output terminal of the fifth transistor, the input terminal of the seventh transistor is connected to the output terminal of the sixth transistor, the output terminal of the seventh transistor is connected to a negative voltage, the input terminal of the eighth transistor is connected to the third conversion unit, the control terminal of the eighth transistor is connected to the read signal, and the output terminal of the eighth transistor is connected to the fourth conversion unit.

* * * * *